US006274084B1

(12) United States Patent
Haudrechy

(10) Patent No.: US 6,274,084 B1
(45) **Date of Patent: *Aug. 14, 2001**

(54) CORROSION-RESISTANT LOW-NICKEL AUSTENITIC STAINLESS STEEL

(75) Inventor: Pascale Haudrechy, Ugine (FR)

(73) Assignees: Ugine SA, Puteaux; Ugine-Savoie Imphy, Ugine, both of (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/346,723

(22) Filed: Jul. 2, 1999

(30) Foreign Application Priority Data

Jul. 2, 1998 (FR) ..... 98 08427

(51) Int. Cl.[7] ..... C22C 38/20; C22C 38/38

(52) U.S. Cl. ..... 420/60; 148/325; 420/34; 420/41; 420/61

(58) Field of Search ..... 148/325; 420/34, 420/41, 60, 61

(56) References Cited

U.S. PATENT DOCUMENTS

| | | | | |
|---|---|---|---|---|
| 3,615,365 | | 10/1971 | McCunn | 75/125 |
| 3,615,366 | | 10/1971 | Allen | 75/125 |
| 3,926,685 | * | 12/1975 | Gueussier et al. | 148/12 |
| 4,842,823 | * | 6/1989 | Sawaragi et al. | 420/584 |
| 5,000,801 | * | 3/1991 | Honkura et al. | 148/325 |
| 5,017,246 | * | 5/1991 | Miyasaka et al. | 148/135 |
| 5,286,310 | | 2/1994 | Carinci et al. | 148/327 |
| 5,362,439 | * | 11/1994 | Bletton et al. | 420/41 |
| 5,571,343 | * | 11/1996 | Ryoo et al. | 148/325 |
| 5,714,115 | * | 2/1998 | Speidel et al. | 420/65 |
| 6,056,917 | * | 5/2000 | Chesseret et al. | 420/60 |

FOREIGN PATENT DOCUMENTS

| | | |
|---|---|---|
| 1 087 022 | 2/1955 | (FR) . |
| 583055 | 1/1977 | (RU) . |

OTHER PUBLICATIONS

Patent Abstracts of Japan; vol. 15, No. 112; & JP 03 002357; Jan. 8, 1991.

* cited by examiner

*Primary Examiner*—Roy King
*Assistant Examiner*—Nicole Coy
(74) *Attorney, Agent, or Firm*—Oblon, Spivak, McClelland, Maier & Neustadt, P.C.

(57) ABSTRACT

Corrosion-resistant low-nickel austenitic stainless steel having the following compostion in percentages by weight:

0.01%<carbon<0.08%,
0.1%<silicon<1%,
5%<manganese<11%,
15%<chromium<17.5%,
1%<nickel<4%,
1%<copper<4%,
$1\times10^{-4}$%<sulfur<$20\times10^{-4}$%,
$1\times10^{-4}$%<calcium<$50\times10^{-4}$%,
0%<aluminum<0.03%,
0.005%<phosphorus<0.1%,
boron<$5\times10^{-4}$%,
oxygen<0.01%, the balance being iron and impurities resulting from the smelting operation.

11 Claims, 3 Drawing Sheets

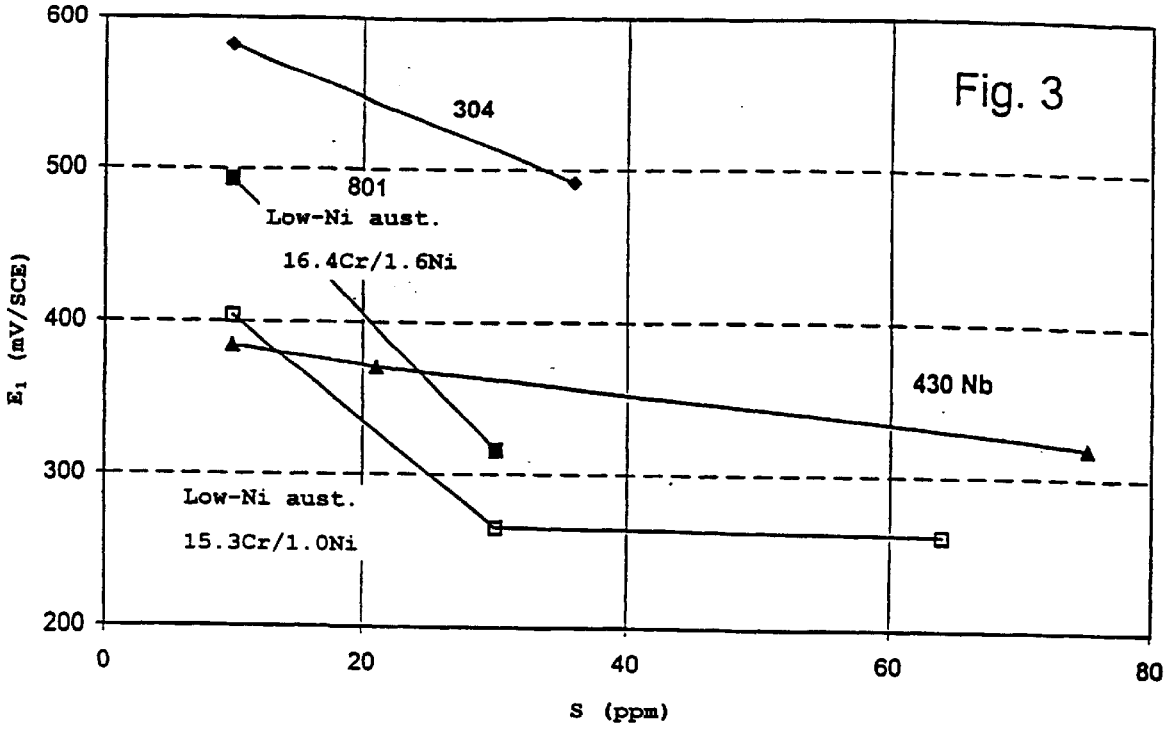
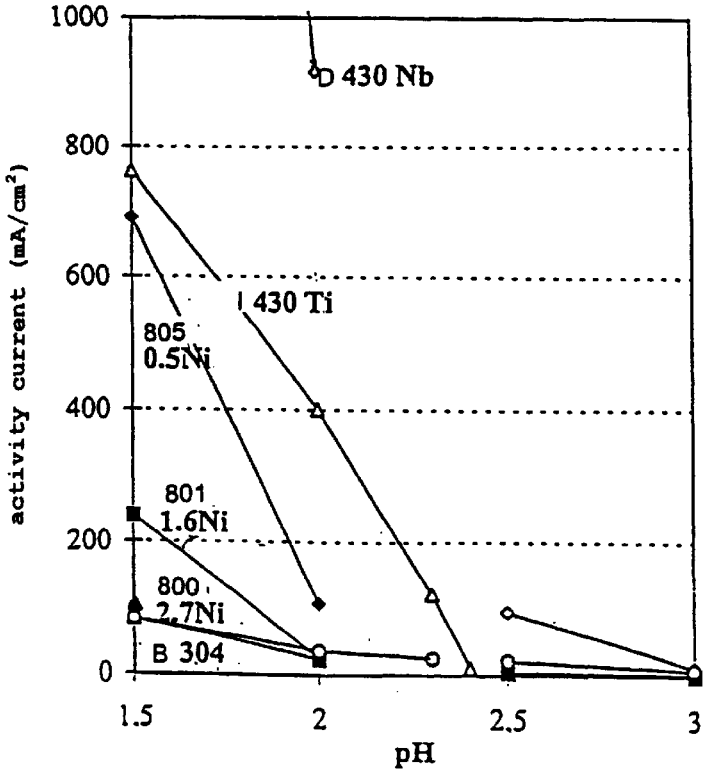
Fig. 4

CORROSION-RESISTANT LOW-NICKEL AUSTENITIC STAINLESS STEEL

BACKGROUND OF THE INVENTION

1. Field of the Invention

The invention relates to a low-nickel austenitic stainless steel. The invention steels are resistant to corrosion, especially generalized corrosion, pitting corrosion and crevice corrosion.

2. Prior art

Patents are known which relate to steels, the composition of which contains, in proportion, the base elements such as chromium, nickel, manganese, copper and silicon, giving a structure of the austenitic type.

For example, French Patent Application No. 70/27948 relates to an austenitic steel whose composition is the following: carbon: 0.05%–0.15%; silicon: 0.3%–1.0%; manganese: 4%–12%; nickel: 0.5%–3%; chromium: 13%–16%; nitrogen: 0.05%–0.2%. This patent application discloses compositions of austenitic stainless steels with a low nickel content and relatively high manganese content, which have corrosion resistance properties equivalent to or superior to those of the conventional commercial grades having a high nickel content, such as AISI 304, 301, 201 or 202, after immersion testing in a chloride-containing medium and a test in $SO_2$. The influence of copper, molybdenum and nickel is clearly mentioned, the nickel content having to be low, but the influence of the elements such as calcium, boron and sulfur is not mentioned.

In another example, Patent JP 54,038,217 relates to an austenitic manganese steel of the following composition: carbon: less than 0.04%; silicon: less than 1%; manganese: 6%–13%; nickel: 1.0%–3.5%; chromium: 13%–19%; niobium: less than 0.3%; copper: 1.0%–3.5%; rare earths: 0.005%–0.3%. The steel described has a corrosion resistance at least equivalent to that of stainless steel of the AISI 304 type and is highly resistant to intergranular corrosion. The elements sulfur, calcium and boron are not mentioned, nor is their influence on the various types of corrosion.

In another example, Patent JP 52,024.914 relates to an austenitic steel whose composition is the following: carbon: 0.11%–0.15%; silicon: less than 1%; manganese: 8.0%–11%; nickel: 1.0%–3.5%; chromium: 16%–18%; nitrogen: 0.05%–0.15%; copper: 0.5%–3.5%; molybdenum: less than 0.5%. It teaches that lowering the nickel content does not impair the corrosion resistance. The influence of elements such as sulfur and boron is not presented.

SUMMARY OF THE INVENTION

One object of the present invention is to provide an austenitic steel of very low nickel content which has a similar corrosion behavior to that of AISI 304 steel, particularly in the field of resistance to pitting, crevice and generalized corrosion.

A main subject of the invention is a corrosion-resistant low-nickel austenitic stainless steel having iron and the following components in percentages by weight based on total weight:

0.01%<carbon<0.08%, 0.1%<silicon<1%,

5%<manganese<11%,

15%<chromium<17.5%,

1%<nickel<4%,

1%<copper<4%, $1\times10^{-4}$%<sulfur<$20\times10^{-4}$%, $1\times10^{-4}$%<calcium<$50\times10^{-4}$%, 0%<aluminum<0.03%, 0.005%<phosphorus<0.1%, boron<$5\times10^{-4}$%, oxygen<0.01%, where the balance comprises, consists essentially of, or consists of iron and impurities resulting from smelting.

Preferably, the non-iron and non-impurity components are as follows:

0.01%<carbon<0.05%, 0.1%<silicon<1%,

5%<manganese<11%,

15%<chromium<17%,

1%<nickel<2%,

2%<copper<4%, $1\times10^{-4}$%<sulfur<$10\times10^{-4}$%, $1\times10^{-4}$%<calcium<$10\times10^{-4}$%, 0%<aluminum<0.01%, 0.005%<phosphorus<0.1%, oxygen<0.01%, The invention steels may furthermore contain from 0.01% to 2% molybdenum.

BRIEF DESCRIPTION OF THE DRAWINGS

The description which follows and the appended figures, all given by way of nonlimiting example, will make the invention clearly understood.

FIG. 3 shows the variation in the pitting potentials in 0.02M NaCl at pH 6.6 and 23° C. as a function of the sulfur content for two reference steels and two steels according to the invention, one of which has a low chromium content in its composition.

FIG. 4 shows characteristics of crevice corrosion behavior in a chloride medium for three steels taken as reference and three steels according to the invention, these having different nickel contents in their composition.

DETAILED DESCRIPTION OF THE INVENTION

Figure 1:
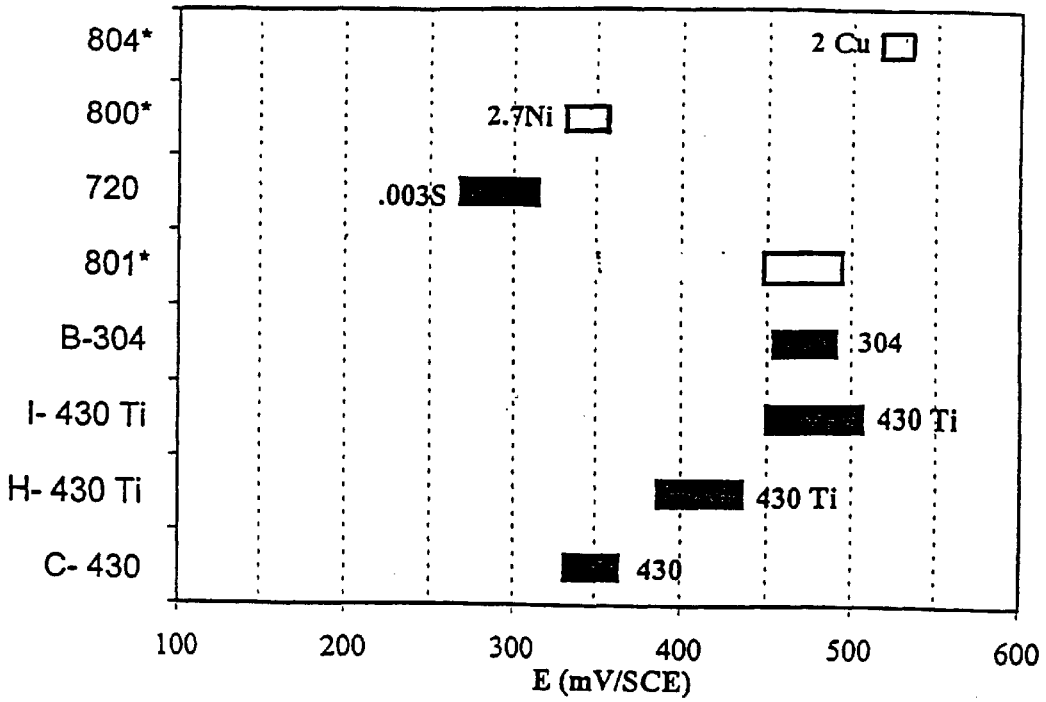
FIGS. 1 and 2 show the comparative values of the pitting potential, respectively in 0.02M NaCl at pH 6.6 and 23° C. and 0.5M NaCl at pH 6.6 and 23° C., for different types of steel taken as reference and for three compositions according to the invention, these being marked by an asterisk.

The steel according to the invention was developed in an attempt to meet corrosion criteria, and in particular the pitting, generalized and crevice corrosion criteria.

To do this, the effect of the following alloying elements was analyzed:

chromium, in a range lying between 15.5% and 17.5%, nickel, in a range lying between 0.5% and 2.7%, carbon, in a range lying between 0.05% and 0.1 1%, nitrogen, in a range lying between 0. 12% and 0.26%, sulfur, in a range lying between 0.001% and 0.007%, copper, in a range lying between 2% and 3%, boron at concentration levels of 0.0025% and less than 0.0005%, calcium at concentration levels of 0.0025% and less than 0.0005%.

The chemical compositions of the steels tested are given in Table 1, the first column giving the reference numbers of the heats of the steels tested, the steels according to the invention being marked with an asterisk. Table 2 gives the chemical compositions of the known reference steels tested, as a comparison.

The various forms of corrosion studied are:

pitting corrosion in a 0.02M NaCl and 0.5M NaCl medium at 23° C., with a pH of 6.6;

crevice corrosion in a chloride medium at 23° C., by plotting polarization curves in a 2M NaCl medium at various acid pH values and then measuring the activity currents;

generalized corrosion in a 2M concentrated sulfuric medium at 23° C., by plotting polarization curves and measuring the activity current;

intergranular corrosion by the STRAUSS test on a steel sensitized by heat treatment and on a TIG-welded steel.

Tables 3 and 4 give the results of corrosion tests.

In the case of pitting corrosion, the potential E1 corresponds to the probability of one pit per $cm^2$ is given. In the case of crevice corrosion, the values of the critical current densities i measured in various 2M NaCl solutions of different pH are given. In the case of generalized corrosion, the values of the critical current densities i in a 2M $H_2SO_4$ acid solution are given. The results of intergranular corrosion are given in Table 4 in the form of weight losses Δm and maximum crack depths in $\mu$m.

TABLE 1

Chemical composition of the low-Ni austenite-type steels studied

| Steel | C | Si | Mn | Ni | Cr | Mo | Cu | S (ppm) | P | $N_2$ | Al | Ca (ppm) | $O_2$ (ppm) | B (ppm) |
|---|---|---|---|---|---|---|---|---|---|---|---|---|---|---|
| 567 | 0.047 | 0.41 | 8.50 | 1.59 | 15.23 | 0.033 | 2.95 | 40 | 0.023 | 0.119 | <0.005 | <5 | 87 | / |
| 584 | 0.081 | 0.40 | 7.47 | 1.07 | 16.28 | 0.037 | 2.70 | 40 | 0.024 | 0.167 | <0.005 | <2 | 101 | / |
| 592 | 0.046 | 0.43 | 8.48 | 1.61 | 15.38 | 0.045 | 3.01 | 30 | 0.024 | 0.202 | <0.005 | <5 | 106 | / |
| 594 | 0.107 | 0.40 | 8.50 | 1.63 | 15.28 | 0.046 | 3.00 | 40 | 0.024 | 0.215 | <0.005 | <5 | 89 | / |
| 596 | 0.116 | 0.40 | 8.56 | 1.62 | 15.28 | 0.045 | 3.01 | 40 | 0.024 | 0.130 | <0.005 | <5 | 98 | / |
| 720 | 0.068 | 0.42 | 8.42 | 1.66 | 16.41 | 0.047 | 3.05 | 29 | 0.025 | 0.202 | <0.005 | 5 | 90 | / |
| 723 | 0.069 | 0.41 | 8.31 | 1.06 | 15.46 | 0.051 | 3.02 | 27 | 0.025 | 0.170 | <0.005 | 3 | 95 | / |
| 774 | 0.075 | 0.76 | 8.55 | 1.09 | 15.27 | 0.049 | 3.02 | 9 | 0.026 | 0.196 | 0.010 | 3 | 22 | <5 |
| 783 | 0.071 | 0.70 | 8.54 | 1.01 | 15.26 | 0.051 | 3.03 | 64 | 0.023 | 0.188 | 0.003 | <2 | 34 | <5 |
| 800* | 0.076 | 0.52 | 6.64 | 2.71 | 16.45 | 0.052 | 3.04 | 12 | 0.026 | 0.150 | 0.005 | 4 | 28 | <5 |
| 801* | 0.076 | 0.59 | 6.05 | 1.63 | 16.36 | 0.052 | 3.04 | 10 | 0.025 | 0.182 | 0.010 | <2 | 30 | <5 |
| 804* | 0.070 | 0.57 | 5.97 | 1.62 | 16.39 | 0.052 | 2.01 | 8 | 0.023 | 0.209 | 0.005 | 3 | 23 | <5 |
| 805 | 0.073 | 0.61 | 6.00 | 0.49 | 16.35 | 0.052 | 3.01 | 8 | 0.023 | 0.240 | 0.004 | 4 | 38 | <5 |
| 806* | 0.073 | 0.57 | 5.94 | 1.61 | 17.44 | 0.056 | 3.02 | 12 | 0.025 | 0.245 | 0.001 | <2 | 40 | <5 |
| 817 | 0.072 | 0.60 | 7.41 | 0.50 | 16.42 | 0.051 | 3.06 | 9 | 0.025 | 0.262 | 0.006 | <5 | 48 | <5 |
| 836 | 0.052 | 0.70 | 7.29 | 1.63 | 16.37 | 0.052 | 3.05 | 7 | 0.023 | 0.216 | 0.014 | 23 | 51 | 25 |
| 838* | 0.050 | 0.78 | 7.47 | 1.01 | 16.37 | 0.051 | 3.04 | 3 | 0.023 | 0.247 | 0.025 | 22 | 47 | <5 |
| 839 | 0.051 | 0.79 | 7.47 | 1.02 | 16.33 | 0.052 | 3.05 | 3 | 0.022 | 0.262 | 0.032 | 24 | 33 | 21 |
| 840 | 0.050 | 0.82 | 7.44 | 0.52 | 16.35 | 0.052 | 3.04 | 3 | 0.024 | 0.266 | 0.032 | 20 | 11 | <5 |
| 841 | 0.052 | 0.80 | 7.46 | 0.50 | 16.35 | 0.051 | 3.05 | 4 | 0.023 | 0.275 | 0.029 | 21 | 12 | 21 |
| 881 | 0.058 | 0.74 | 7.51 | 1.62 | 16.36 | 0.049 | 3.04 | 6 | 0.034 | 0.216 | 0.017 | <2 | 30 | 29 |
| 882* | 0.056 | 0.76 | 7.61 | 1.66 | 16.38 | 0.053 | 3.06 | 10 | 0.035 | 0.212 | 0.007 | 5 | 58 | <5 |

*Steels according to the invention

TABLE 2

Chemical composition of the reference steels studied

| Steel | C | Si | Mn | Ni | Cr | Mo | Cu | S (ppm) | Nb | Ti | P | N | Al | Ca (ppm) | $O_2$ (ppm) | B (ppm) |
|---|---|---|---|---|---|---|---|---|---|---|---|---|---|---|---|---|
| A 304 | 0.037 | 0.424 | 1.42 | 8.62 | 18.08 | 0.207 | 0.210 | 10 | <0.002 | 0.004 | 0.018 | 0.043 | 0.007 | <2 | 32 | / |
| B 304 | 0.037 | 0.385 | 1.41 | 8.58 | 18.23 | 0.199 | 0.213 | 36 | <0.002 | 0.003 | 0.019 | 0.041 | <0.010 | 3 | 8 | / |
| C 430 | 0.036 | 0.373 | 0.46 | 0.13 | 16.39 | 0.023 | 0.042 | 30 | <0.002 | 0.004 | / | 0.026 | 0.032 | / | 22 | / |
| D 430 Nb | 0.024 | 0.39 | 0.41 | 0.09 | 17.21 | 0.006 | 0.006 | 45 | 0.388 | 0.005 | 0.004 | 0.010 | 0.0015 | / | 53 | / |
| E 430 Nb | 0.004 | 0,25 | 0.47 | 0.13 | 16.46 | 0.015 | / | <10 | 0.335 | 0.004 | / | 0.009 | 0.012 | / | 32 | / |
| F 430 Nb | 0.022 | 0.43 | 0.51 | 0.19 | 16.63 | 0.016 | 0.055 | 21 | 0.765 | 0.006 | / | 0.033 | 0.045 | / | 27 | / |
| G 430 Nb | 0.035 | 0.35 | 0.40 | 0.13 | 16.49 | 0.014 | 0.051 | 75 | 0.714 | 0.002 | / | 0.036 | 0.021 | / | 28 | / |
| H 430 Ti | 0.026 | 0.32 | 0.43 | 0.09 | 16.83 | 0.005 | <0.002 | 29 | <0.002 | 0.375 | 0.007 | 0.014 | <0.002 | / | 48 | / |
| I 430 Ti | 0.025 | 0.40 | 0.44 | 0.09 | 17.45 | 0.004 | 0.006 | 42 | <0.002 | 0.382 | 0.004 | 0.010 | 0.003 | / | 69 | / |

TABLE 3

Results of the pitting, crevice and generalized corrosion tests

| | Pitting corrosion ($E_1$ in mV/SCE) | | Crevice corrosion ($\mu$NaCl) $i_{crit}$ (2M A/cm$^2$) | | | | Generalized corrosion (2M $H_2SO_4$) $i_{crit}$ ($\mu$A/cm$^2$) | |
|---|---|---|---|---|---|---|---|---|
| | 0.02M NaCl | 0.5M NaCl | pH = 1.5 | pH = 2.0 | pH = 2.5 | pH = 3.0 | 1st peak | 2nd peak |
| 584 | 372 | 132 | 359 | 104 | 33 | 12 | 50 | 157 |
| 720 | 317 | 92 | 167 | 79 | 16 | 10 | 0 | 99 |
| 723 | 265 | 56 | 622 | 160 | 25 | 6 | 712 | 343 |
| 774 | 405 | 193 | 1140 | 93 | 4 | 3 | 743 | 329 |
| 783 | 261 | / | / | / | / | / | / | / |
| 800* | 359 | 191 | 84 | 23 | 4 | 3 | 0 | 116 |
| 801* | 494 | 315 | 240 | 24 | 4 | 2 | 0 | 115 |
| 804* | 536 | 316 | 253 | 20 | 6 | 3 | 392 | 160 |
| 805 | 527 | 236 | 730 | 108 | 5 | 3 | 184 | 156 |
| 806* | 576 | 407 | 92 | 19 | 3 | 2 | 0 | 117 |
| 836 | 327 | 134 | 135 | 34 | 6 | 2 | 90 | 148 |
| 840 | 310 | 203 | 247 | 20 | 3 | 2 | 120 | 186 |
| 841 | 388 | 246 | 461 | 30 | 3 | 3 | 0 | 145 |
| 881* | 422 | 215 | 124 | 13 | 3 | 2 | 0 | 104 |
| 881 water quench* | 471 | 281 | / | / | / | / | / | / |
| 882* | / | / | 279 | 38 | 4 | 2 | 0 | 112 |
| A-304 | 583 | / | / | / | / | / | / | / |
| B-304 | 491 | 317 | 83 | 35 | 21 | 9 | 0 | 226 |
| C-430 | 367 | 122 | / | / | 25 | 19 | / | / |
| D-430 Nb | / | / | / | 915 | 95 | 12 | 0 | $73 \times 10^3$ |
| E-430 Nb | 385 | / | / | / | / | / | / | / |
| F-430 Nb | 370 | / | / | / | / | / | / | / |
| G-430 Nb | 320 | / | / | / | 440 | 56 | / | / |
| H-430 Ti | 445 | 273 | / | 511 | 11 | 0.3 | / | / |
| I-430 Ti | 517 | 296 | 762 | 401 | 9 | 2 | 0 | $20 \times 10^3$ |

TABLE 4

Results of the intergranular corrosion tests

| | T2 650° C.-10 min-water quench | | T'2 650° C.-10 min-water quench | | T1 700° C.-30 min-water quench | | TIG weld | |
|---|---|---|---|---|---|---|---|---|
| | Δm (mg) | crack depth ($\mu$m) | Δm (mg) | crack depth ($\mu$m) | Δm (mg) | crack depth ($\mu$m) | Δm (mg) | crack depth ($\mu$m) |
| 567 | / | / | / | / | 4.8 | 20 | 5.7 | 0 |
| 584 | 3.3 | 0 | / | / | 27.7 | 2500 | 2.8 | 0 |
| 592 | / | / | / | / | 4.95 | 65 | 2.3 | 50 (melt zone) |
| 594 | 5.4 | 22 | / | / | 70.6 | 2500 | 4.4 | 50 (melt zone) |
| 596 | 9.4 | 1250 | / | / | 68.9 | 2500 | 4.2 | 0 |
| 720 | 9 | 250 | 15.7 | 537 | 47 | 550 | 4.1 | 10 |
| 723 | 11 | 50 | / | / | 16.8 | 1600 | 4.5 | 0 |
| 800* | 10.7 | 40 | 26.0 | 2500 | 32.2 | 500 | / | / |
| 801* | 12.2 | 20 | / | / | 31.1 | 1500 | / | / |
| 805 | 5.1 | 0 | / | / | 23.1 | 2500 | / | / |
| 817 | / | / | 11.5 | 663 | 13.9 | 2500 | / | / |
| 836 | 8.6 | 35 | / | / | 8.0 | 60 | 6.2 | 0 |
| 838 | / | / | 6.8 | 24 | 6.0 | 31 | / | / |
| 839 | / | / | 4.4 | 32 | 4.8 | 34 | / | / |
| 840 | / | / | 4.7 | 14 | 5.6 | 44 | / | / |
| 841 | / | / | 6.4 | 20 | 8.3 | 101 | / | / |
| 881* | 7.5 | 90 | / | / | 10.3 | 75 | / | / |
| 882* | / | / | / | / | 7.5 | 30 | / | / |

The following comments discuss the effects of various alloying elements introduced into the composition according to the invention.

The Effect Of Sulfur

Sulfur has no effect on the generalized corrosion behavior. In the field of crevice corrosion, it slightly reduces the resistance to initiation and to propagation of the corrosion, with a higher critical current i at a pH of greater than or equal to 2.0 when the sulfur content increases. On the other hand, its effect is much greater in the field of pitting corrosion. By lowering the sulfur content to levels of about $10\times10^{-4}$% in the composition of steels containing little nickel in their composition, the pitting initiation behavior is greatly improved.

From the standpoint of pitting corrosion, the steel according to the invention has the same properties as an AISI 304 reference steel or an AISI 430 Ti steel, which contains about $30\times10^{-4}$% sulfur, while the low-nickel steel, with a sulfur content of $30\times10^{-4}$%, behaves like an AISI 430 Nb reference steel.

The observed effect of sulfur on the compositions according to the invention is unexpected. The effect is much smaller and more uniform on austenitic reference steels or on ferritic steels of the 430 Nb type, as shown in FIG. 3.

The Effect Of Nickel

It is shown that nickel is highly beneficial in the field of generalized corrosion and of crevice corrosion.

In the field of generalized corrosion, a nickel content of 1.6% makes it possible to obtain a steel behaving like an AISI 304 steel, whereas it appears that a nickel content of 0.6% remains insufficient.

In the field of crevice corrosion, a minimum nickel content of 1% is necessary in order to obtain a level of resistance which is acceptable and markedly superior to that of a steel of the AISI 430 Ti type.

However, a nickel content of less than 2% is preferable in order to have good pitting corrosion behavior.

FIG. 4 shows, in the form of curves giving the values of the activity currents as a function of the pH of a chloride solution, the crevice corrosion behavior of various reference steels and of steels according to the invention.

The activity currents are proportional to the corrosion rate. The closer the curve to the X-axis, the lower the corrosion rates and therefore the better the corrosion behavior.

The Effect Of Copper

Copper has a beneficial effect in the field of generalized corrosion. In order for the behavior to be equivalent to that of a steel of the AISI 304 type, the behavior of steel 804 shows that a copper content of 2% may be regarded as being insufficient, while a copper content of 3% is better, as shown by the behavior of steel 801.

The values of the measured activity currents are given in Table 3. In the case of steel 804, it should be noted that a second activity peak is observed at about a potential of −390 mV/SCE. This peak also has to be taken into consideration in order to determine the corrosion rate in $H_2SO_4$ acid.

Figure 2:
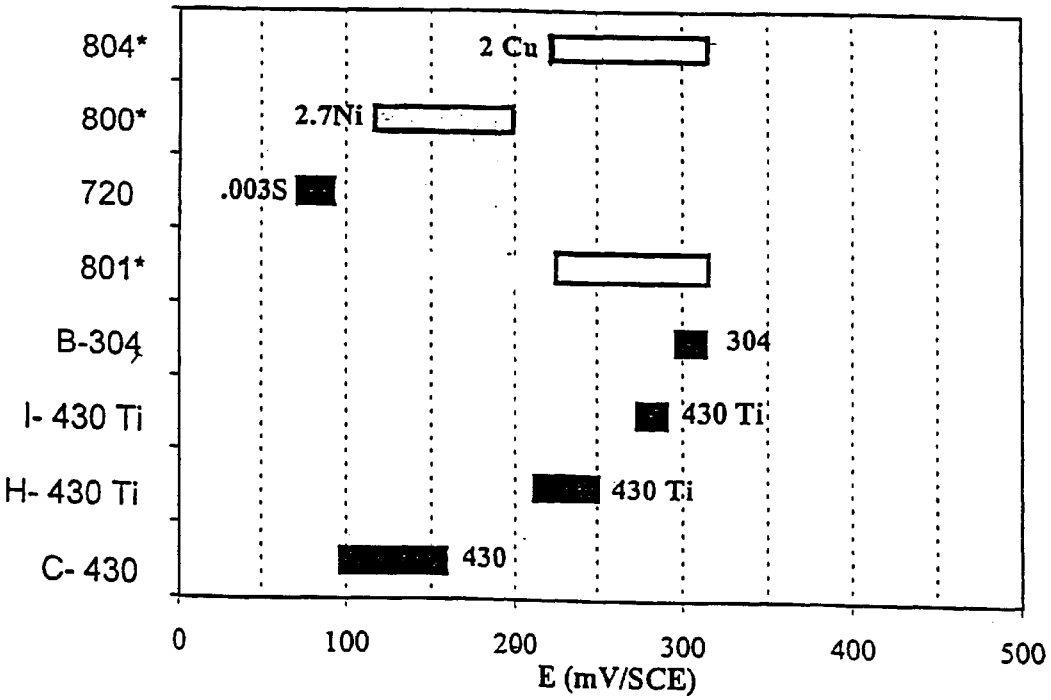

However, copper has a deleterious effect on pitting corrosion behavior, as shown in FIGS. 1 and 2 or Table 3. Steel 801, the copper content of which is 3%, has lower pitting potentials than those of steel 804, the copper content of which is 2%. Thus, the copper content according to the invention is preferably limited to 4%.

The Effect Of Boron

Figure 5:
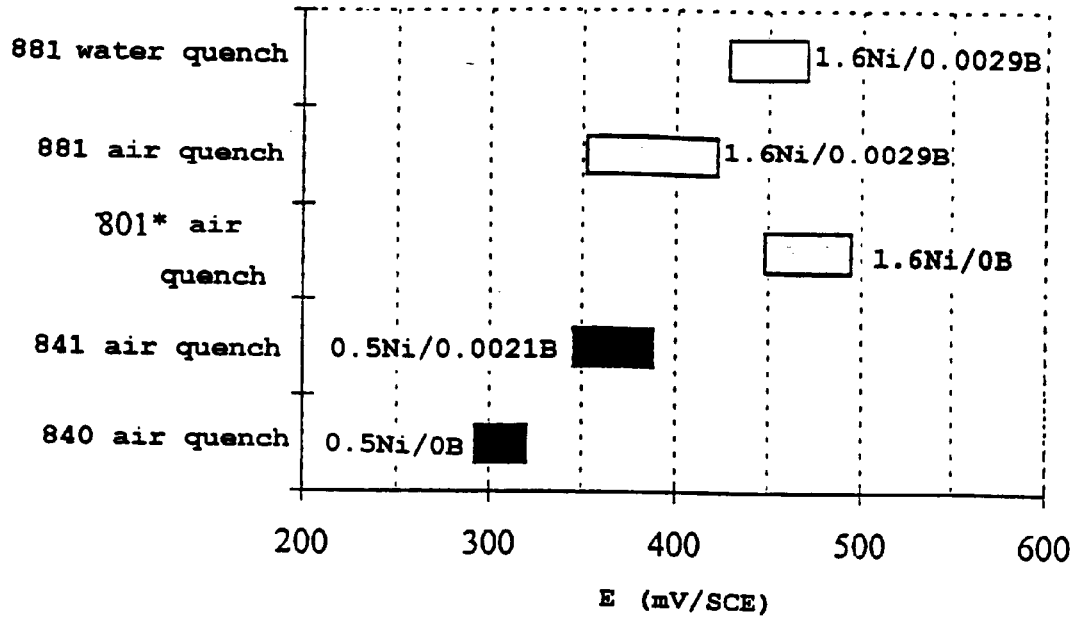
FIGS. 5 and 6 show the comparative values of the pitting potential, respectively in 0.02M NaCl at pH 6.6 and 23° C. and in 0.5M NaCl at pH 6.6 and 23° C., for various types of steel allowing the influence of boron to be demonstrated.
Figure 6:
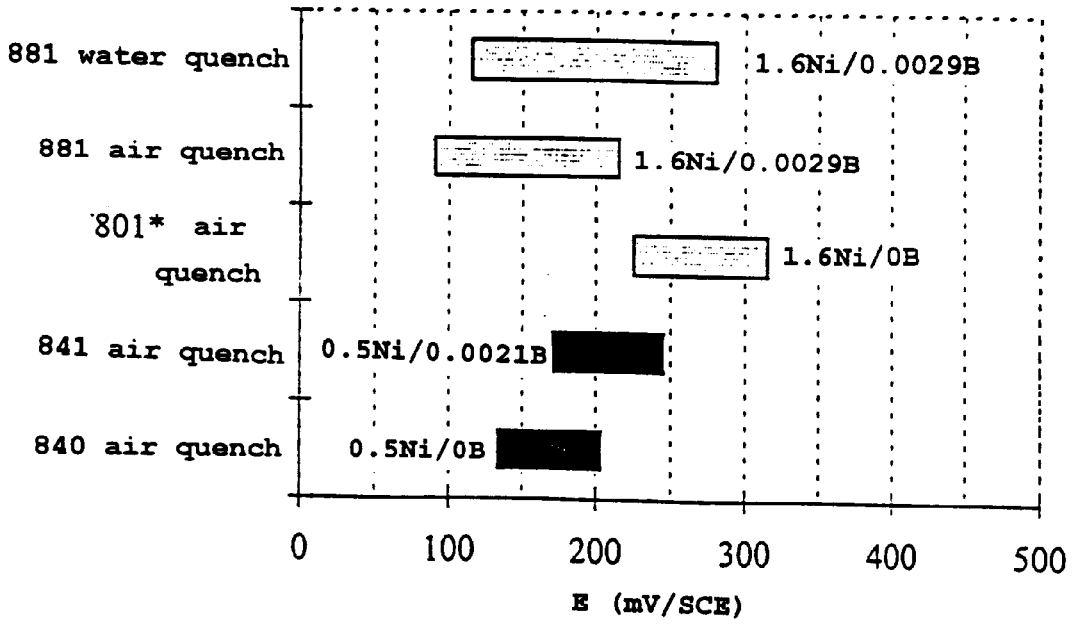

Boron has no effect on generalized corrosion. In the field of pitting corrosion, as shown in FIGS. 5 and 6, it seems to be slightly beneficial on steels containing a small amount of calcium, such as steel 841, but it is deleterious on steel such as 881 and 801 which contain no calcium. For a steel containing boron but no calcium, a rapid quench to 1100° C. followed by a water quench would have to be carried out in order again for the pitting corrosion behavior to be similar to that of a steel which contains neither boron nor calcium and is simply air-quenched.

Finally, in the field of intergranular corrosion, as shown in Table 4, it has a slightly deleterious effect in some cases. Preferably, the composition according to the invention does not contain the element boron, or else it has contents which are always less than $5\times10^{-4}$%.

The Effect Of Calcium

It has been demonstrated that calcium is deleterious in the field of pitting corrosion, most particularly in a moderate chloride medium, i.e. using NaCl with a normality of 0.02M. This behavior is shown in Table 3. Steels 836 and 840, which contain $23\times10^{-4}$% and $20\times10^{-4}$% calcium, respectively, have lower pitting potentials than those of steels 881 (air-quenched) and 805 which do not contain calcium.

In order to obtain pitting corrosion behavior closest to the AISI 304 reference and to the AISI 430 Ti steel, the calcium content must be very low, i.e. less than $20\times10^{-4}$% and preferably less than $10\times10^{-4}$%.

The Effect Of Chromium

Chromium is beneficial in the field of generalized corrosion, pitting corrosion and crevice corrosion, as is apparent in Table 3 by comparing the values obtained on steels 584, 723, 801 and 806. A minimum content of 15% is necessary to ensure good corrosion behavior, but a content of 16.5% is preferable in order to obtain a corrosion resistance which corresponds to a corrosion resistance comparable to that of a reference steel of the AISI 304 or AISI 430 Ti type.

With a chromium content of greater than 17%, such as steel 806, the corrosion is even better, but it becomes difficult to obtain a steel having an entirely austenitic structure.

The Effect Of Carbon And Nitrogen

Carbon has a predominant effect on steel in the field of intergranular corrosion. Steels having various carbon and nitrogen contents were tested according to the STRAUSS test after forming a weld or after a heat-treatment sensitization. The results of this test are given in Table 4.

It may be seen that a maximum carbon content of 0.07% is desirable and that a preferred content of 0.05% makes it possible to obtain corrosion behavior similar to that of an AISI 304 reference steel. A nitrogen content of between 0.1% and 0.3% is acceptable. The corrosion behavior of the steel according to the invention, although containing little nickel in its composition, is comparable to that of an AISI 304 reference steel.

Furthermore, the behavior of the steel according to the invention is greatly superior to that of steels of the AISI 430 Ti type in the field of generalized and crevice corrosion.

The patents and patent applications mentioned herein are incorporated in their entirety by reference, as is French patent application 98 08427.

What is claimed is:

1. An austenitic stainless steel comprising, in percent by weight based on total weight:

0.01%<carbon<0.08%,
0.1%<silicon<1%,
5%<manganese<11%,
15%<chromium<17.5%,
1%<nickel<4%,
1%<copper<4%,
$1\times10^{-4}$%<sulfur<$20\times10^{-4}$%,
$1\times10^{-4}$%<calcium<$50\times10^{-4}$%,
0%<aluminum<0.03%,
0.005%<phosphorus<0.1%,
boron<$5\times10^{-4}$%,
oxygen<0.01%, and iron and impurities resulting from smelting.

2. The steel as claimed in claim 1, comprising:

0.01%<carbon<0.05%,
0.1%<silicon<1%,
5%<manganese<11%,
15%<chromium<17%,
1%<nickel<2%,
2%<copper<4%,
$1\times10^{-4}$%<sulfur<$10\times10^{-4}$%,
$1\times10^{-4}$%<calcium<$10\times10^{-4}$%,
0%<aluminum<0.01%,
0.005%<phosphorus<0.1%,
oxygen<0.01%.

3. The steel as claimed in claim 1, further comprising 0.01% to 2% molybdenum.

4. The steel as claimed in claim 2, further comprising 0.01% to 2% molybdenum.

5. The austenitic stainless steel according to claim 1, wherein said steel has a potential E1 of 359–576 mV/SCE as measured in 0.02M NaCl solution at 23° C. and a pH of 6.6.

6. The austenitic stainless steel according to claim 1, wherein said steel has a potential E1 of 191–407 mV/SCF as measured in 0.5M NaCl solution at 23° C. and a pH of 6.6.

7. The austenitic stainless steel according to claim 1, wherein said steel has a critical current density of 84–279 A/cm$^2$ as measured in a 2M NaCl solution at a pH of 1.5.

8. The austenitic stainless steel according to claim 1, wherein said steel has a critical current density of 13–108 A/cm$^2$ as measured in a 2M NaCl solution at a pH of 2.0.

9. The austenitic stainless steel according to claim 1, wherein said steel has a critical current density of 3–6 $A/cm^2$ as measured in a 2M NaCl solution at a pH of 2.5.

10. The austenitic stainless steel according to claim 1, wherein said steel has a critical current density of 2–3 $A/cm^2$ as measured in a 2M NaCl solution at a pH of 3.0.

11. The austenitic stainless steel according to claim 1, wherein said steel has a second peak in a critical current of 104–160 $\mu A/cm^2$ as measured in 2M $H_2SO_4$ solution at 23° C.

* * * * *